United States Patent [19]

Kolloch et al.

[11] 4,133,362

[45] Jan. 9, 1979

[54] PROTECTIVE HANDLE FOR A HAND-HELD STRIKING TOOL

[75] Inventors: Hardy Kolloch, Neuss-Weckhoven; Karl-Friedrich Tillmanns, Remscheid-Hasten; Hans W. Tillmanns, Remscheid; Günter Tillmanns, Remscheid-Hasten, all of Fed. Rep. of Germany

[73] Assignee: C. Friedr. Tillmanns KG, Remscheid, Fed. Rep. of Germany

[21] Appl. No.: 858,528

[22] Filed: Dec. 7, 1977

[30] Foreign Application Priority Data

Dec. 15, 1976 [DE] Fed. Rep. of Germany ..... 2657558

[51] Int. Cl.[2] ..... B25D 3/00

[52] U.S. Cl. ..... 145/24; 145/78

[58] Field of Search ..... 145/24, 25, 78

[56] References Cited

FOREIGN PATENT DOCUMENTS 2610663 9/1977 Fed. Rep. of Germany ..... 145/78

*Primary Examiner*—James L. Jones, Jr.
*Assistant Examiner*—J. T. Zatarga
*Attorney, Agent, or Firm*—Michael J. Striker

[57] ABSTRACT

A protective handle is provided for a hand-held striking tool having an impact-imparting leading surface and an elongated stem extending in an outward direction from the impact-imparting surface. The handle includes an elongated elastic socket grip lying on and defining an axis and fitting over and firmly united with a portion of the elongated stem. The socket grip has two axially spaced ends, one of the ends being closer to and the other of the ends being farther from the impact-imparting leading surface of the tool. A concave guard is mounted at this other end of the socket grip and is open in the direction away from the leading surface. A convex guard is mounted on the socket grip between the concave guard and the one end. This convex guard is connected to the concave guard, and is open in the direction towards the leading surface.

17 Claims, 2 Drawing Figures

PROTECTIVE HANDLE FOR A HAND-HELD STRIKING TOOL

BACKGROUND OF THE INVENTION

The invention pertains to a protective handle for a striking tool, such as a jackhammer, which is directed by hand and which is provided with a handguard. Conventional handguards are outwardly directed guards designed to deflect an inaccurately descending hammer from striking a hand of an operator. These handles are conventionally hollow and are made of synthetic resin. These handles are located at the upper end of the striking tool and have a plate-like shape with a stretched rim. These handles are intended to protect the directing hand of the operator against the hammer blow. These conventional handles have the disadvantage of failing to absorb the force of the hammer blow. Instead, they transmit this force to the directing hand; consequently, the hand may be bruised or hemorrhaged by the vibrating handle.

SUMMARY OF THE INVENTION

An object of the invention is to make available a protective handle which absorbs rather than transmits vibrations of impact.

Another object of the invention is to provide an impact vibration-absorbing handle which is easily and economically produced.

Conventional striking tools have an impact-imparting leading surface and an axially elongated stem extending outwardly from the impact-imparting surface. The inventive concept is embodied in a handle which includes an elongated elastic socket grip lying on and defining an axis and fitting over and firmly united with a portion of the elongated stem of the striking tool. The socket grip has two axially spaced ends, one end being relatively remote from the impact-imparting surface of the tool and the other being closer to this surface. A concave guard is mounted at the remote end of the socket grip; this concave guard is open in the direction away from the impact-imparting leading surface. A convex guard is mounted on the socket grip between the axially closer end and the concave guard; this guard is connected to the concave guard and is open in the direction towards the impact-imparting leading surface.

The concave guard may be generally bowl-shaped. It has an annular bottom plate having a center through which the axis defined by the socket grip passes. The bottom plate extends radially about and outwardly from the axis. This bottom plate may be perpendicular to the axis; or the bottom plate may be outwardly inclined so as to extend both radially from the axis and away from the position of the impact-imparting leading surface of the tool. At its radially outermost extent, the bottom plate has a radially remote end. Together with an imaginary line extending from the remote end and perpendicular to the socket grip, a nonperpendicularly radially extending bottom plate forms an acute angle. The bottom plate has a bottom surface which faces the leading surface of the tool.

The concave guard also has an annular sidewall. The sidewall extends from the remote end of the bottom plate in a direction away from the impact-imparting leading surface of the hammer. The annular sidewall is rounded about the axis of the socket guard. In a particularly useful embodiment, the annular side wall has a V-shaped cross section with two ends. One end of the V-shaped sidewall is integrally connected with the remote end of the bottom plate. The other end is free and is axially further from the location of either the impact-imparting surface or the bottom plate. These ends of the V-shaped sidewall are desirably superposed or at least substantially aligned in such a manner that a straight line passing through both of them will be parallel to the axis of the socket grip. The vertex of the V-shape extends radially beyond the distance spacing the ends of the sidewall from the axis of the socket grip.

The concave guard as described is desirably mounted on the socket grip in such a manner that a line connecting a point on the vertex of the sidewall with another point diametrically opposite it will also be perpendicular to the axis of the socket grip, or at least substantially so. The concave guard is mounted close to the axially farther end of the socket grip, (farther relative to the position of the leading surface), being desirably located below the farther end by a distance which is slightly more than the axial length between the bottom surface of the bottom plate and the vertex of the sidewall. The free end of the sidewall forms an axially inwardly directed rim (relative to the axis of the socket grip) and is located above the axially farther end of the socket grip (relative to the leading surface) in order to prevent the socket grip from jutting beyond the concave guard.

The concave guard can be equipped with a cylindrical sleeve which projects below the bottom surface of the bottom plate. Relative to the concave guard, the sleeve has an upper end and a lower end. In a particularly desirable embodiment, the upper end of the sleeve is integral with the bottom plate of the concave guard and the lower end of the sleeve extends axially therebelow and terminates with an annular ledge having an L-shaped cross section — with the foot of the L-shape projecting radially, perpendicularly, for example, from the axis of the socket grip. The inner wall of the cylindrical sleeve is provided with a threading, such as a saw tooth threading. Advantageously, the sleeve is reinforced by a cross piece extending from the bottom plate to an axially lower portion of the sleeve. Desirable reinforcement is provided by a cross piece which covers and adheres to the bottom surface of the bottom plate and extends downwardly to cover and adhere to all radially outwardly facing portions of the sleeve which are not to be covered by the convex guard.

The convex guard is mounted between the concave guard and the end of the socket grip, which is axially closer to the leading surface, and is connected to the concave guard by way of the sleeve. The ledge-like shape of the lower end of the sleeve is desirable because this can be used in a snap-lock connection between the convex guard and the sleeve. With such an embodiment, the convex guard is easily replaceable.

The snap-on connection is formed by providing the convex guard with an annular portion which is reciprocally-shaped relative to the ledge-like shape of the lower end of the cylindrical sleeve so that the ledge-like shape penetrates the convex guard as it engages the reciprocally shaped portion. The convex guard has a top plate which may have a center through which the axis of the socket grip and the socket itself passes — as well as the cylindrical sleeve. This top plate is advantageously inversely shaped relative to the bottom plate of the concave guard. The top plate extends radially outwardly from both the cylindrical sleeve and the axis of the socket gear — the top plate may extend perpendicularly from the sleeve or it may be inclined so as to extend both radially from the axis and towards the position of the impact-imparting surface of the tool. At its radially outermost extent from the axis, the top plate has a radially remote end. Together with an imaginary line extending from this remote end perpendicularly to the socket grip, a nonperpendicularly extending top plate would form an acute angle.

In order to snap onto the sleeve, the convex guard has a radially proximate end with an axially upwardly extending collar (relative to the concave guard which is above) into which a recess reciprocally shaped relative to the ledge-shaped end of the sleeve is formed. An annular groove should suffice as the recess. Advantageously, this recess is formed in a socket grip facing surface of the collar and is extended in the direction towards the impact-imparting leading surface so that the recess communicates with the hollow depression defined by the convex guard. As it is interlocked with this recess, the ledge-shaped end of the sleeve then extends through the convex guard and borders the hollow depression.

For further protection of the directing hand, the convex guard may be covered with a cushion.

The socket grip may also be provided with an outer thread, preferably a saw tooth thread, which ends in a stop ring preventing further axial displacement. This outer thread cooperates with the inner thread of the sleeve. In order to tightly screw the concave guard to the socket grip, the saw tooth thread may be conical. Advantageously, the socket grip is cylindrical and is provided with elongated slots in the vicinity of the outer thread.

The hollow interior of the socket grip can be provided with glutinous furrows which are preferably widened at the ends of the socket grip. The axially farther end (relative to the leading surface) lies in a plane which crosses the hollow depression of the concave guard. According to a further embodiment of the invention, the socket grip, the concave guard, and/or the convex grip can be integrally formed as one piece.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
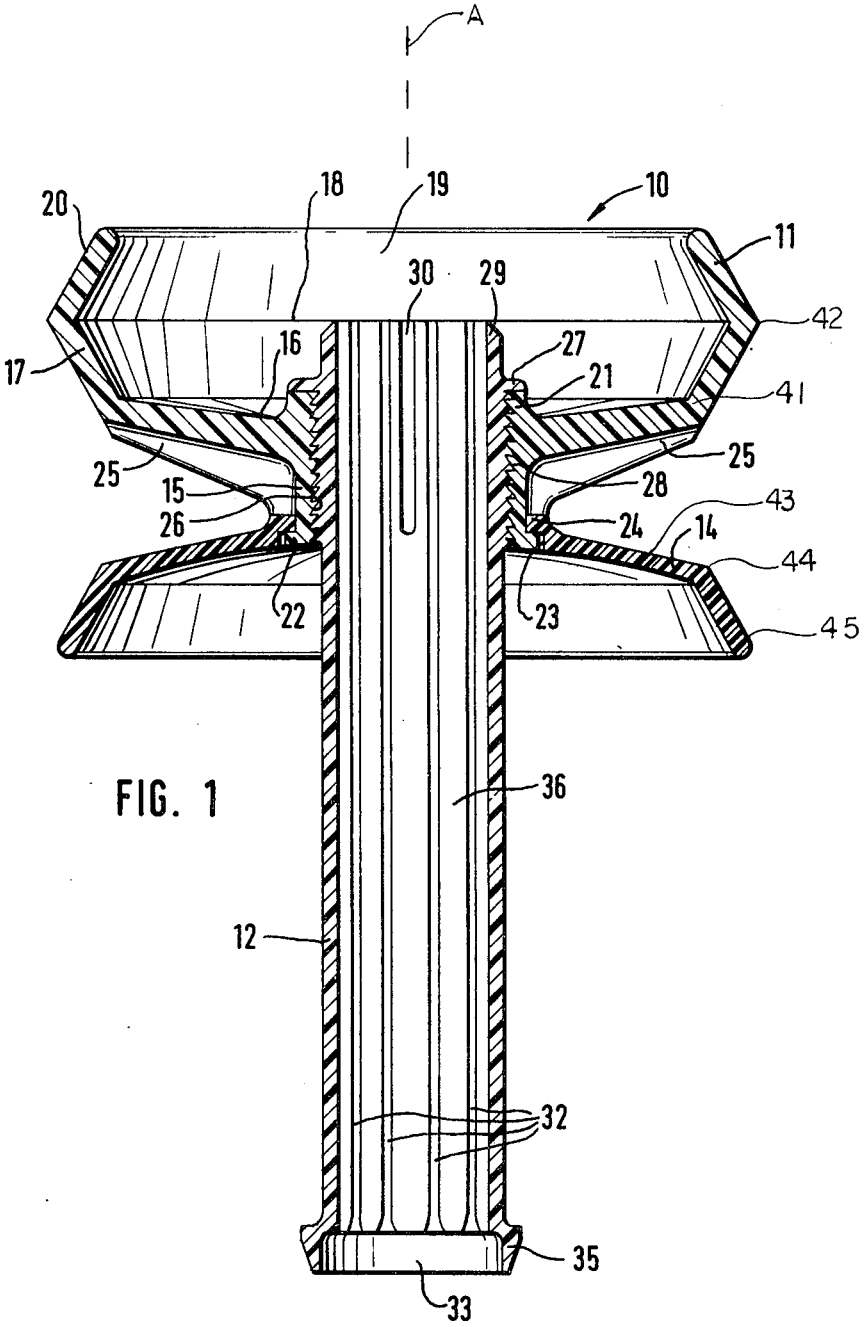
FIG. 1 is a longitudinal cross section of an embodiment of the inventive concept.
Figure 2:
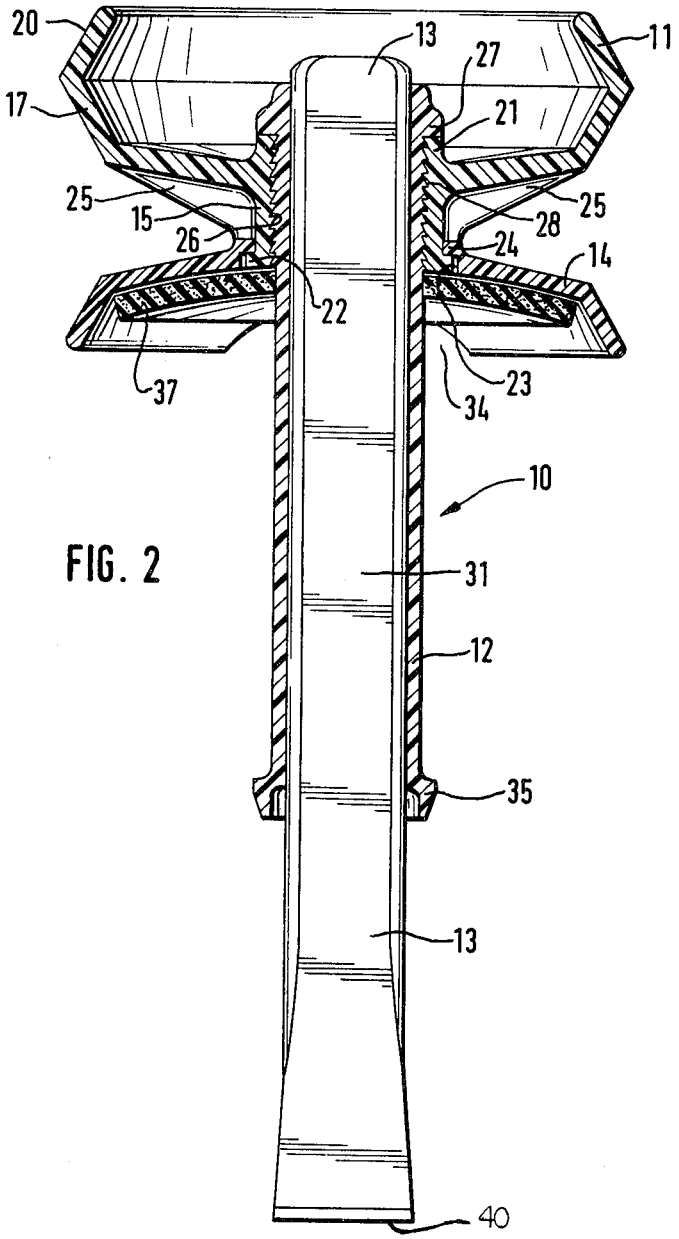
FIG. 2 is a longitudinal cross section of a second such embodiment, this shown as being mounted on a hand-held striking tool.

The handle 10 shown in FIGS. 1 and 2 consists of a bowl-shaped concave upper guard 11, an elongated socket grip 12 which fits over the elongated stem 13 of the striking tool, and a convex lower guard 14. These components of the handle 10 are all made of flexible synthetis resin.

The cylinrdical grip 12 lies on and defines an axis A passing through the hollow interior thereof. The socket grip 12 has two axially spaced ends; one end 35 is closer to and the other end 29 is farther from the impact-imparting leading surface of the tool (FIG. 1 does not show the tool as being connected with the inventive handle; FIG. 2 shows such connection with the leading surface 40.)

The concave guard 11 extends radially outwardly from the socket grip 12. The concave guard 11 includes a bottom plate 16 which is radially outwardly inclined in a direction away from end 35 of the socket grip 12. The bottom plate 16 has a radially remote end 41. A perpendicular extending from the socket ring 12 to remote end 41 would form a right triangle with the bottom plate 16 being the hypotenuse and an acute angle being defined between the bottom plate 16 and the perpendicular.

Below the bottom plate 16 is a cylindrical sleeve 15 which is concentric with the socket grip 12 and which has an internal diameter equal to the outer diameter of the socket grip 12. The sleeve 15 extends axially from bottom plate 16 in direction towards end 35 of the socket grip 12; this sleeve 15 fits over a portion of the socket grip 12. The sleeve 15 is preferably integrally formed with the concave guard 11 and includes an upper end 21 which protrudes above the bottom plate 16 and along the socket grip 12 in a direction away from end 35. Sleeve 15 has a lower end 22 which is ledge-shaped with the foot of the ledge extending substantially radially perpendicularly from socket grip 12.

The sidewall 17 of the concave guard 11 extends first away from the remote end 41 in a direction sloped away from end 35 and outwardly from the socket grip 12 itself. At vertex 42, the sidewall 17 abruptly changes direction, extends from vertex 42 in a direction away from end 35 but towards end 29 and terminates at rim 20. The vertex 42 is located in a plane 18 in which the end 29 is located. Therefore, the end 29 does not jut beyond the sidewall 17. The hollow depression 19 within the sidewall 17 is annular with its outer perimeter being conical.

The convex guard 14 directly shields the hands of the operator whereas the concave guard 11 is really intended to deflect a misaimed hammering piece. The convex guard 14 is connected to the sleeve 15 about its ledge-shaped lower end 22. To interlock with this lower end 22, the convex guard 14 has an annular collar 24 and an annular groove 23 below collar 24 (closer to end 35) and reciprocally shaped relative to the lower end 22. The lower end 22, the groove 23 and the collar 24 together constitute a snap-on connection detachably holding convex guard 14 to sleeve 15. Collar 24 is shown in FIG. 1 as fitting over lower end 22 of the sleeve 15.

Groove 23 and ledge 22 are slightly spaced so as to permit the convex guard 14 to rotate relative to the concave guard 11.

The convex guard 14 is open in a direction opposite to that in which the concave guard 11 is open — i.e., the convex guard 14 is open in the direction towards end 35 of the socket grip 12. The convex guard 14 has a top plate 43 which is radially outwardly extended, being somewhat inclined in a direction towards end 35. At vertex 44, sidewall 45 extends from the radially remotest end of the top plate 43 in a direction also radially outwardly from the sleeve 15 but being more sharply inclined towards the end 35. The top plate 43 and sidewalls 45 together make the convex guard 14 look like the upper part of a bell.

Sleeve 15 is reinforced by cross piece 25 which braces against the bottom plate 16 and sleeve 15. The sleeve 15 has an inner thread 26 with a saw-tooth profile. The inner thread 26 cooperates with an outer thread 28 located on an upper part of the socket grip 12 (near but below end 29) and being reciprocally saw-tooth profiled. The concave guard 11 is screwed onto the socket guard 12 via these threads 26, 28. An end collar 27 or stop ring on the socket grip 12 limits this axial displacement of the concave guard 11. End collar 27 is preferably located along a plane which passes through the remote end 41 of the bottom plate. The end 29 of the socket grip 12 lies along plane 18 which also passes through vertex 42 of sidewall 17. Socket grip 12 has elongated slots 30 in the area of the outer threading 28, extending axially from end 29 to annular groove 23.

The socket grip 12 is glued to elongated stem 31 of the tool 13. The hollow interior 36 of the socket grip 12 is molded with adhesive-receiving grooves 32 which are widened at the end 35 and opens into a recess 33. This end 35 of the socket grip 12 is doughnut-shaped.

A second variation of the inventive concept is illustrated in FIG. 2. The handle 10 is seated on the tool 13. The handle 10 corresponds to that illustrated in FIG. 1, so the reference numerals identify corresponding elements.

The convex guard 14 has a cushion 37 covering that top plate surface directed towards end 35 of the socket grip 12. Three recesses 34 are molded into the convex guard 14 at least in the sidewall thereof in order to make it possible to prevent the tool 13 from rolling and to assure a secure positioning of the tool 13 against a work surface.

In another variation of the inventive concept, the socket grip 12 is glued only at its end 35 to the elongated stem of the tool 13. The tool 13 can be a bit, a pin punch or some other kind of punch driven by a hammer.

It will be understood that each of the elements described above, or two or more together, may also find a useful application in other types of constructions differing from the types described above.

While the invention has been illustrated and described as embodied in a protective handle for a hand-held striking tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A protective handle for a hand-held striking tool having an impact-imparting leading surface and an elongated stem extending in an outward direction from the impart-imparting leading surface, the handle comprising, in combination, an elongated elastic socket grip lying on and defining an axis and fitting over and firmly united with a portion of the elongated stem, said socket grip having two axially spaced ends, one of said ends being closer to and the other of said ends being farther from the impact-imparting leading surface of the tool; a concave guard mounted at said other end of said socket grip and being open in direction away from the leading surface; and a convex guard mounted on said socket grip between said concave guard and said one end and connected to said concave guard, said convex guard being open in direction towards the leading surface.

2. The handle of claim 1, said concave guard including a substantially V-shaped sidewall having a vertex which lies in a plane perpendicular to the axis and bordering said other end of said socket grip.

3. The handle of claim 1, said concave guard including a bottom plate extending radially outwardly from said socket grip and a cylindrical sleeve extending axially from said bottom plate and being concentric with said socket grip, said sleeve having an inner surface with a diameter equal to the outer diameter of said socket grip and fitting over a portion of said socket grip, and further having an upper end which projects into said concave guard and a lower end which is annularly ledge-shaped.

4. The handle of claim 3, said sleeve having a thread on its internal surface.

5. The handle of claim 3, further comprising a cross piece at least partially covering and thereby reinforcing said bottom plate and said sleeve.

6. The handle of claim 3, further comprising snap-on locking means for detachably connecting said sleeve to said convex guard.

7. The handle of claim 6, said means comprising said ledge-shaped lower end of said sleeve, a correspondingly shaped annular collar on said convex guard and fitting on said lower end of said sleeve, and an annular groove below said collar and into which said ledge-shaped lower end fits.

8. The handle of claim 1, said convex guard having an interior surface facing said leading surface and being covered with a cushion.

9. The handle of claim 1, said convex guard having a radially outer rim and having a plurality of longitudinally extending recesses extending through said rim and widening in direction towards said leading surface, whereby said recesses act as locks against rolling movement of the striking tool.

10. The handle of claim 4, said socket grip having an outer surface and having a thread on said outer surface, said thread engaging said thread of said sleeve.

11. The handle of claim 10, said thread of said sleeve being a saw tooth thread, said thread of said socket grip being a saw tooth thread, which is conical, whereby said convex guard is tightly secured onto said socket sleeve.

12. The handle of claim 10, said socket grip being cylindrical and having an inner surface defining a hollow interior and having elongated slots extending axially opposite said thread of said outer surface and over substantially the same axial distance.

13. The handle of claim 1, said socket grip having an inner surface which is provided with axially extending grooves for glue, whereby said socket grip is glued to the tool.

14. The handle of claim 13, said axially extending grooves being widened at said one end.

15. The handle of claim 1, said other end of said socket grip lying in a plane which crosses the hollow depression defined by and inside said concave guard.

16. The handle of claim 1, said socket grip and concave guard having a one-piece construction.

17. The handle of claim 1, said socket grip, said concave guard and said convex guard having a one-piece construction.

* * * * *